US007570912B2

(12) United States Patent
Fromm et al.

(10) Patent No.: US 7,570,912 B2
(45) Date of Patent: Aug. 4, 2009

(54) PRESSURE ROLL FOR FUSING OPERATION

(75) Inventors: Paul M Fromm, Rochester, NY (US); Richard C Benton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/183,178

(22) Filed: Jul. 31, 2008

(65) Prior Publication Data

US 2008/0286019 A1 Nov. 20, 2008

Related U.S. Application Data

(62) Division of application No. 11/350,631, filed on Feb. 9, 2006, now Pat. No. 7,483,667.

(51) Int. Cl.
*G03G 15/20* (2006.01)

(52) U.S. Cl. ..... 399/331; 399/333

(58) Field of Classification Search ..... 399/331–333
See application file for complete search history.

(56) References Cited

U.S. PATENT DOCUMENTS

2003/0147680 A1 8/2003 Kawamura et al.

*Primary Examiner*—David M Gray
*Assistant Examiner*—Erika Villaluna
(74) *Attorney, Agent, or Firm*—James J. Ralabate

(57) ABSTRACT

Washers are used for a pressure roll in a fusing system of an electrophotographic system that improve the functionality and durability of the pressure roll. These washers are made up of a rigid ring section having flexible (less rigid) fingers projecting from the inner periphery of the ring. This provides a more uniform pressure to be exerted in the pressure roll and, consequently, a more uniform nip for better handling and fusing.

4 Claims, 5 Drawing Sheets

PRESSURE ROLL FOR FUSING OPERATION

CROSS REFERENCES TO RELATED APPLICATIONS

This invention relates to an electrophotographic system, and more specifically, to a pressure roll or roller used in the toner fusing step of said system. This application is a Divisional application of Ser. No. 11/350,631 filed Feb. 9, 2006.

BACKGROUND

Generally, in a commercial electrostatographic reproduction apparatus (such as copier/duplicators, printers or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member bearing the transferred image is transported away from the dielectric member and the image is fixed or fused to the receiver member by heat and/or pressure to form a permanent reproduction thereon. In a typical fusing process where the toner is fused to the paper or receiving member, two rolls are used through which the paper travels during the toner fusing. One roll, usually the harder roll, is a fuser roll, the second roll is the pressure roll or the softer roll.

Typical pressure rolls ("Softer Roll") that are used in a fusing system have an elastomeric coating like silicone rubber which may or may not have a thin layer of another material over the surface of the roll. A functional nip is formed when the softer roll is pressed into the fuser roll ("Harder Roll"). The fuser roll generally comprises a metal core with a hard Teflon (™ of DuPont) coating or thin elastomer.

The pressure rolls or softer rolls are typically constructed of a cylindrical steel core or rod having positioned over it an elastomer or rubber material cylindrical roll. At the ends of the elastomer roll, generally, are positioned end plates or steel washers. In any system when a hard roll (fuser roll) is pressed against and contacts a softer roll nips are formed throughout the length of the pressure roll in contact with the fuser roll. These pressure zones ultimately cause the softer material to contact the support plates and create wear, shortening roll life and causing debris in the system. Also, once excessive wear takes place and an uneven nip is formed, improper fusing of the toner can result causing imperfect copies on the paper or receiving member. In addition, because of this wear problem, frequent changes requiring new softer rolls are required. Generally, the elastomeric rolls have typically been manufactured from a single elastomeric material, such as silicon rubber, of a uniform hardness as determined by a durometer. From both a cost standpoint and performance standpoint, any improvement in the softer roll construction that would extend roll life and improve performance at the fuser station would be very desirable. Thus, eliminating an uneven nip and material deterioration of the pressure roll would extend pressure roll life and improve fusing performance.

Nip forming rollers in fusers are frequently not long enough to avoid the effect the lack of constrain on the end face of the rubber has on the nip width uniformity at the edges of the widest paper path. That is, the nip width decreases as the proximity to the roller end decreases due to rubber deforming axially at the ends versus only circumferentially in the middle of the roller when subjected to radial interference with the indenting roll. In the past, a rigid washer has been mounted over the core of the roller and biased against the rubber with a spring (wavy washer) and constrained with a retainer ring. Or a fairly rigid washer has been fastened to the core end via several small screws. The screwed-on prior art method uses less space along the axis of the roll than the wavy washer method but requires very tight control on the rubber to core dimension since there is very little compliance. Also, thermal expansion of the rubber produces large increases in the washer to rubber load.

One reason for rapid degradation of the elastomer end face at the washer contact area causing formation of an uneven or non-uniform nip is the presently used rigid washers that are located at each end of the core of the pressure rolls. These washers are biased against the rubber coating on the soft pressure roll. These washers are fastened to the core ends via several small screws. Rubber trimming tolerance and thermal expansion was to large variation in contact force between the washer and rubber. The use of these washers invariably causes rubber wear allowing the nips to get narrower as it gets closer to the roll end as the roll ages. As above noted, a non-uniform nip causes uneven contact with the paper, uneven fusing of the toner, paper wrinkles and excessive pressure roll wear eventually requiring replacement.

SUMMARY

Since the end washers play a significant roll in the pressure exerted along the length of the pressure roll and in the formation of the non-uniform nip, special attention was given to improve this drawback. The embodiments herein disclosed describe end washers used to constrain the ends of a pressure roll in a fuser system. The end constraint minimizes axial deformation of the rubber coating which helps maintain a more substantially uniform nip width. The end washers proposed are a low cost replacement option providing both axial loading and easy attachment to the rubber roll core. The washer has a stiff outer perimeter for axial loading at the roll surface perimeter. Multiple fingers at the inner diameter (ID) of this outer perimeter provide both spring force and mounting to the core. Mounting techniques constraining the ID fingers between the core and the inner bearing race is also proposed to enable easier re-manufacturing. This is an excellent low cost redesign of the end washers that will improve assembly and re-manufacturability and will substantially improve the formation of a uniform nip. This will facilitate better fusing, even pressure on the paper and will extend the life the fuser roll.

The present invention provides the use of a washer with a fairly stiff outer perimeter supported by a set of more flexible fingers projecting from this outer perimeter towards the center. These fingers are further shaped to provide a longer deformable length (large radius) as they are formed to project axially along the roll and attached to the core. This set of relatively compliant fingers allows the washer to apply a uniform and predictable spring force on the rubber end face over reasonable tolerance limits of the core to rubber trim and variation from thermal expansion of the rubber. The stiffer outer portion of the washer is able to exert high enough local load in the portion of the roll forming the nip thereby reducing the tendency of the nip to get narrower as it gets closer to the roll end. It was found that a much more uniform nip is formed when the washers of the present invention are used in the pressure roll as compared to previously used washers.

Generally, in an embodiment of the present invention, a flexible pressure roll is provided for use in an electrophotographic system which comprises in operative relationship, a cylindrical core component, a main portion elastomeric coating encircling at least a major part of said core component and end plates positioned as washers at each end portion of said main portion elastomeric roll. The washers comprise a substantially rigid circular ring having flexible fingers projecting from an inner portion of the ring towards the center of the ring.

It has been found that the equally spaced fingers apply a uniform and constant pressure to the elastomer coating on the pressure roll. This ensures equal pressure around the total end portion of the elastomer thereby forming a near perfect uniform size nip and minimizing the tendency of the nip to narrow as it approaches the end of the roll.

An embodiment of the present invention provides the use of a washer with a fairly stiff outer perimeter supported by a set of more flexible fingers projecting towards the center. These fingers are further shaped to provide a longer deformable length (large radius) as they are formed to project axially along the roll and engage the core of the roller parallel to its long axis. A hooked finger embodiment is designed to engage a groove on the inside of the bore that the bearing is pressed into. Alternatively, in another embodiment, the groove and corresponding hook can be eliminated and the washer retained by the press fit of the bearing alone. Or the hook feature can project towards the center to engage a groove on the outside diameter of a core with or without a bearing press over it. In applications without a hook, some of the fingerlike projections are left flat to act as locator features when butted up against the end face of the core. The tip of the fingers contact the bottom of the bearing bore to limit pre-defection of the finger spring shape caused by them sticking to the bearing rather than the core during the bearing press operation.

This set of relatively compliant fingers allows the washer to apply a predictable equal spring force on the rubber end face over reasonable tolerance limits of the core to rubber trim. The washer load is also less influenced by thermal expansion of the rubber than a washer of the same thickness screwed to the core end. The stiffer outer portion of the washer is able to exert high enough local load in the portion of the roll forming the nip thereby reducing the tendency of the nip to get narrower as it gets closer to the roll end. It even uses −0.5 mm less space than the screw head of a M2.5 screw. It is several dollars less expensive than the prior art rigid washer set-up and substantially less expensive than the wavy washer set-up due to the cost of drilling and tapping a dozen small holes.

The hooked designs of one embodiment, while very effective, could suffer from a problem of not being easily removable for re-manufacturing. The washer may be sometimes distorted. In this second embodiment, the hook-less design retained by the press fit load of the bearing is as easily removable as the bearing.

The hooked configuration has the advantage of greater flexibility of the finger set if the clearance between the hooks and the bearing and bore is left large enough for the finger to rotate slightly around the hook tip. When the finger is tightly constrained between the core and bearing, the deformable zone of the finger is considerably stiffer compared to the case where rotation around the hook is allowed.

This hooked and hook-less designs were made and tested and both found to be very effective. A tolerance ring was used between the bearing and the washer fingers in the outer third of the bearing bore. This allows the sheet metal thickness tolerance to be typical. The hook-less design retained by press fit is being used and sheet metal thickness controlled to tight tolerance via a coining operation.

Lastly, an unexpected advantage of this design seems to be that the dust resulting from abrasions of the rubber by the washer seems to migrate towards the center instead of outward. A simple ring of adhesive film applied over the fingers covering the holes between them is an effective trap of this dust.

DETAILED DISCUSSION OF DRAWINGS AND PREFERRED EMBODIMENTS

Figure 1:
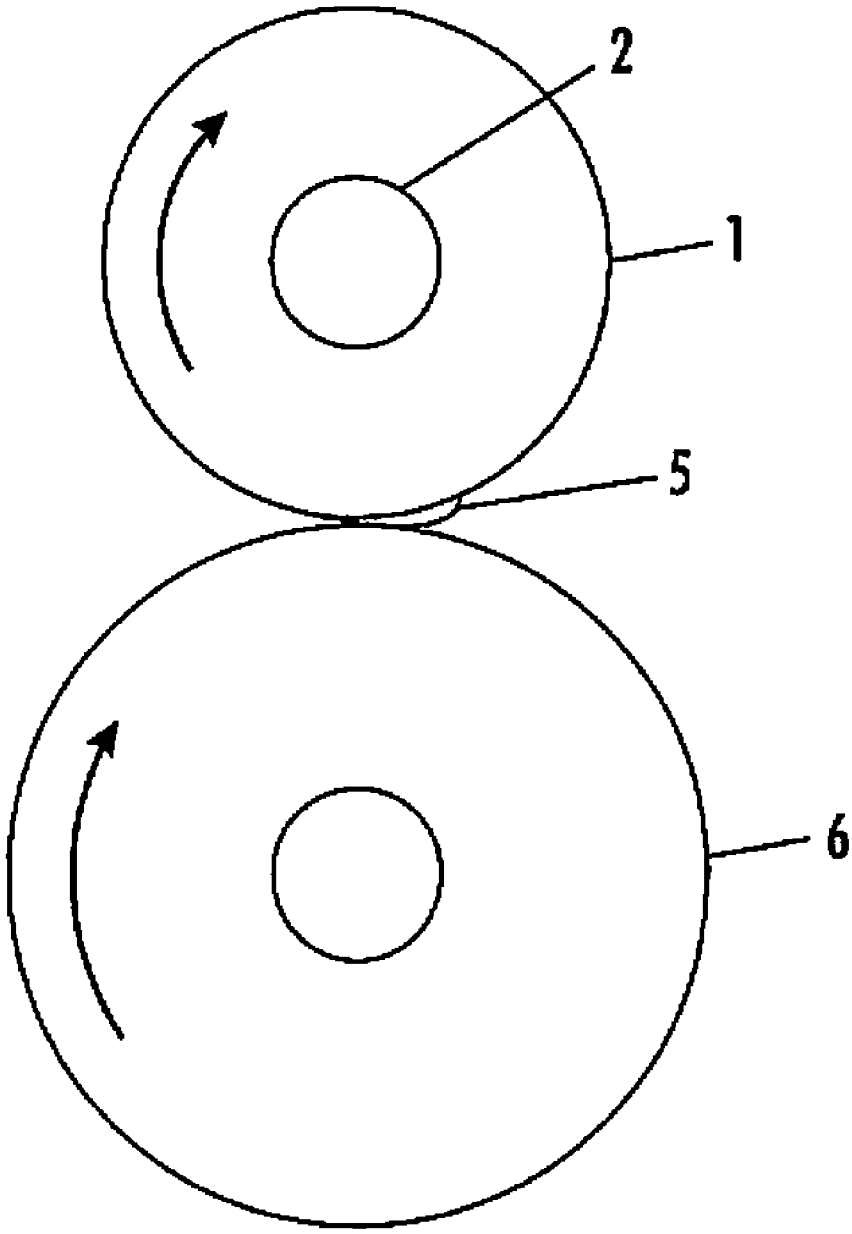
FIG. 1 illustrates an end view of a fuser roll and pressure roll where a nip is formed between said rolls.
Figure 2:
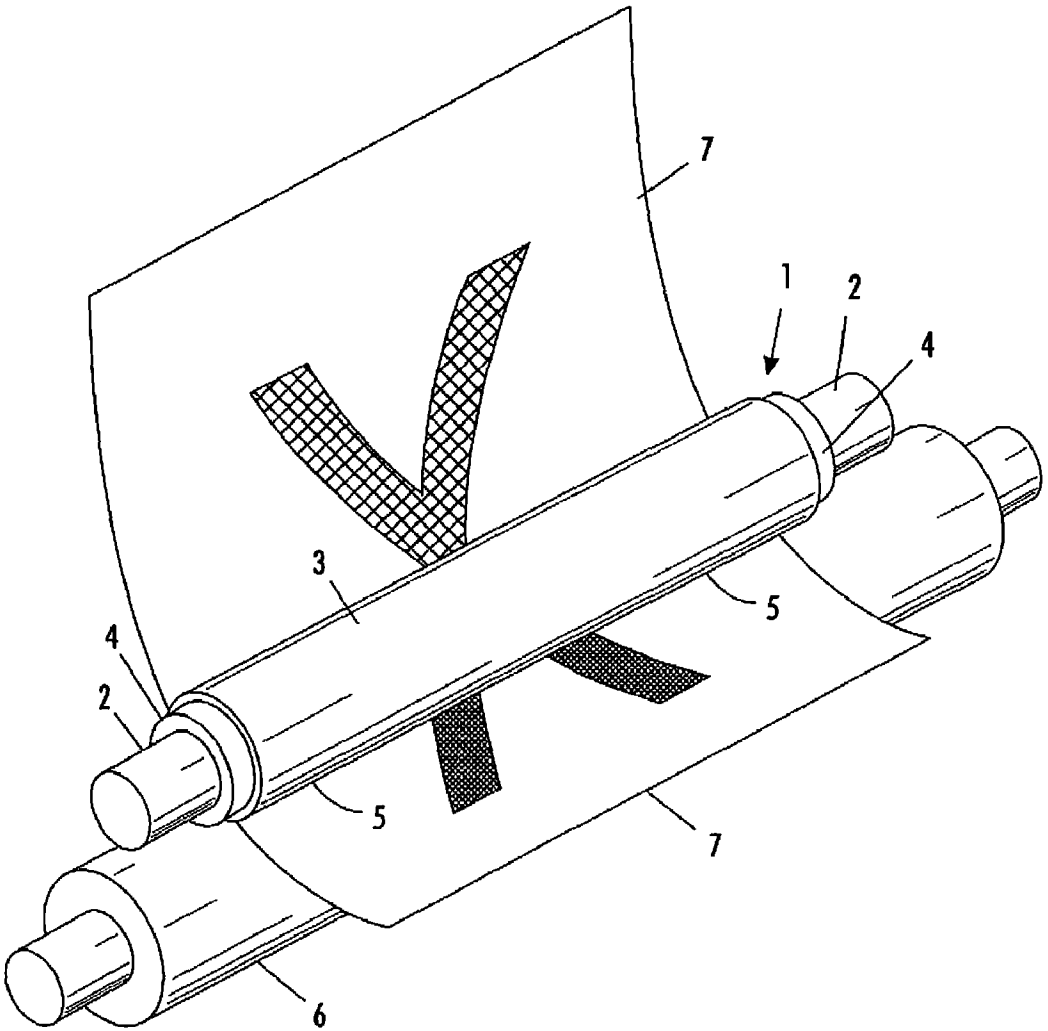
FIG. 2 illustrates a perspective view of a fuser roll and pressure roll where a nip is formed longitudinally at the contact point of these two rolls.

In FIG. 1, a pressure roll 1 having a softer surface is pressed against a fuser roll 6 having a hard surface. The soft surface of pressure roll 1 is thereby deformed to form a nip 5 at the contact point of rolls 1 and 6. This nip travels longitudinally along the entire contact surface of rolls 1 and 6. A paper with image to be fused travels between the nip 5 and the hard fusing surface of fuser roll 6 (as shown in FIG. 2). If the nip is uneven or non-uniform along this contact point, the toner on the paper will be unevenly fused and paper may wrinkle.

In FIG. 2, the pressure roll 1 comprises a cylindrical core component 2 that is covered by a cylindrical main portion elastomeric roll 3, endplates 4 (or washers 4) and a nip 5. The main portion elastomeric roll (main portion roll) 3 is made from a lower abrasion resistance material than the hard coating on fuser roll 6. In use, the pressure roll 1 wears most often at its end portions since elastomer 3 bulges outward and contacts and rubs on washers 4. The main portion roll 3 is typically made from a single softer elastomeric material as measured by a Durometer.

All of the main portion roll 3 and washers 4 encircle a cylindrical core or rod 2. The toned paper 7 is fed between pressure roll 1 and fuser roll 6 as illustrated in FIG. 2. Fuser roll 6 has a much harder surface than the surface of pressure roll 1, therefore, pressure roll 1 will, in the prior art, usually wear especially at its end portions where the elastomer 3 bulges outward and contacts and rubs on washers 4. Once wear occurs, the action of the elastomer of main roll 3 in the prior art rubbing on the support plate (washers) 4 causes the elastomer to wear and create debris in the system. A functional nip 5 is formed when the softer roll 1 is pressed into the fuser roll 6. If the softer roll 1 is only slightly wider than the paper 7, a support plate or plates 4 at the end of the roll 1 is needed to help contain the elastomer 3 as it is deformed to produce a nip. However, this action may create debris and, if left unattended, could shut down the electrophotographic printer or copier. This present roll embodiment with improved washers 4 and uniform nip 5 not only extends the life of roll 1 but prevents frequent cleaning of debris caused in the prior art systems.

If the nip 5 is smaller at the end portions near washers 4, then uneven fusing or wrinkle could occur. In the present embodiments, the end portions of nip 5 are maintained at approximately the same size as the remaining nip portion with very little distortion.

Figure 3:
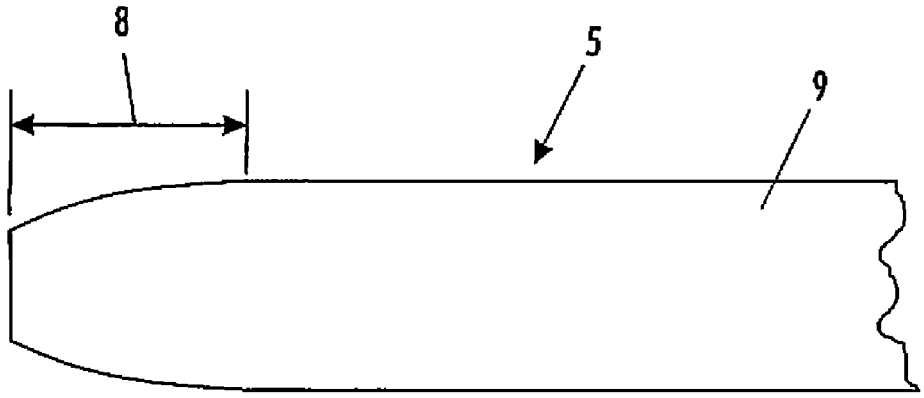
FIG. 3 PRIOR ART
FIG. 3 is a plan view of a distorted nip end portion as formed in prior art systems.

In FIG. 3, a nip end portion of the prior art is shown having a distortion 8 which is in part caused by using no washers in the prior art. Notice that the main portion 9 is wider than the distorted end portions 8 causing uneven fusing of toner and paper 7 wrinkle.

Figure 4:
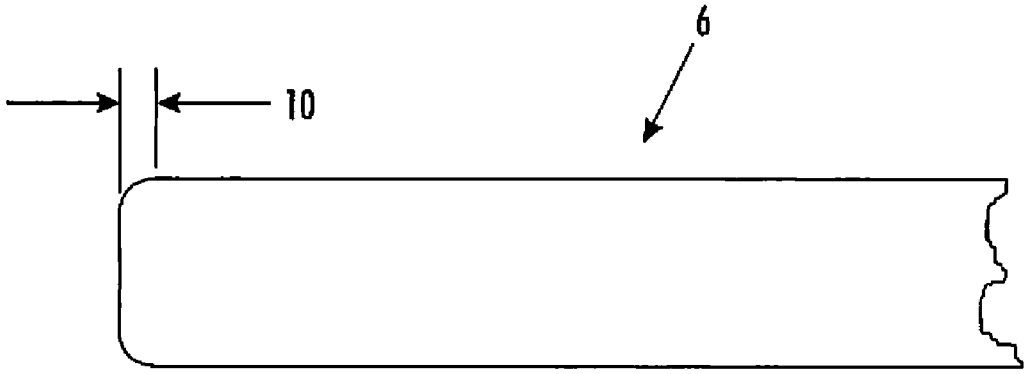
FIG. 4 is a plan view of an improved, more uniform nip portion formed using the washers of the present invention.

In FIG. 4, a nip 5 of the present invention is illustrated where there is only a slight deviation of the nip at end section 10. This provides better and more uniform fusing and paper movement.

Figure 5A:
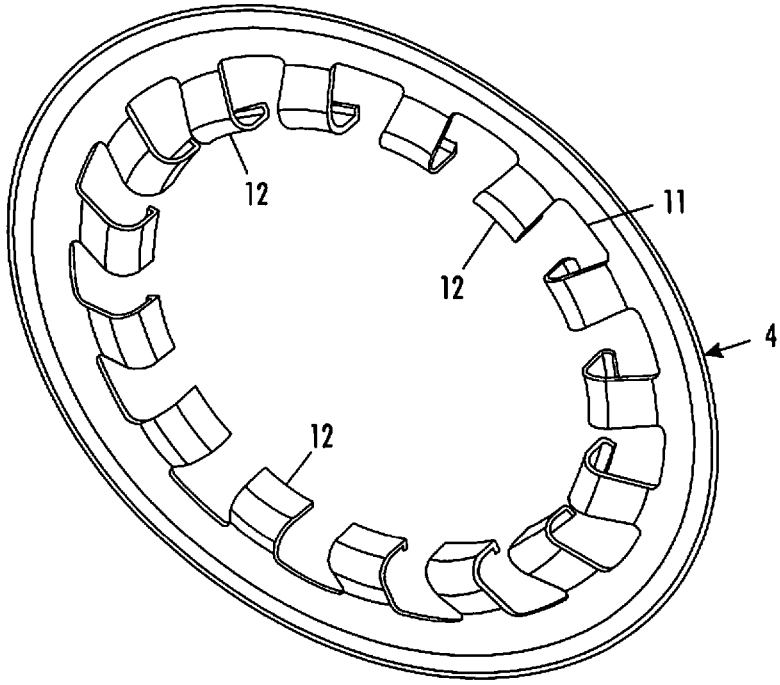
FIGS. 5A and 5B illustrate a hooked finger embodiment of a washer of this invention.
Figure 5B:
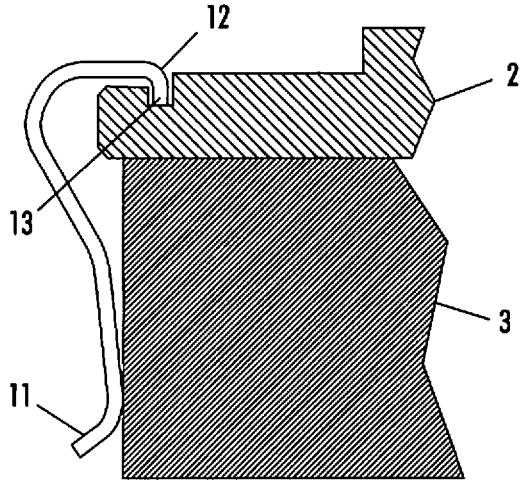

In FIGS. 5A and 5B, a hooked washer embodiment of end washers 4 of the present invention are illustrated.

Figure 6A:
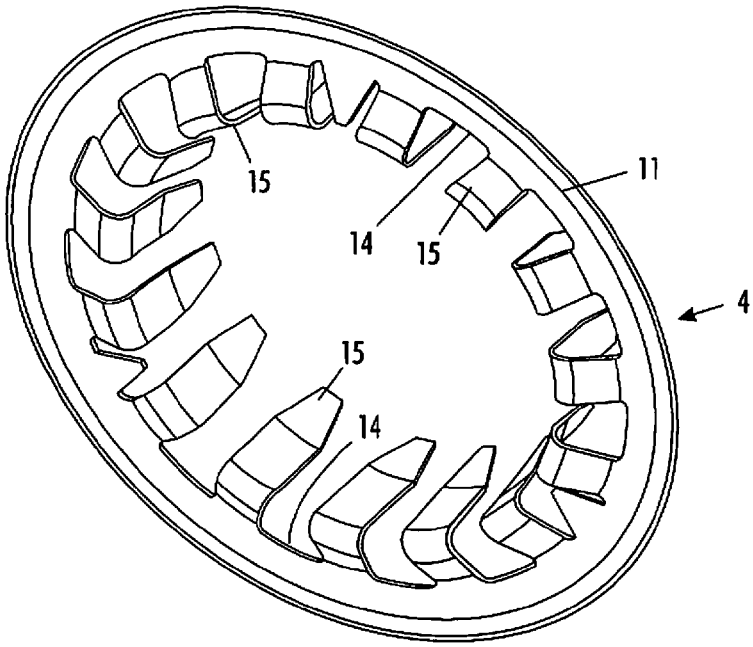
FIGS. 6A and 6B illustrate a hook-less finger embodiment of a washer of this invention.
Figure 6B:
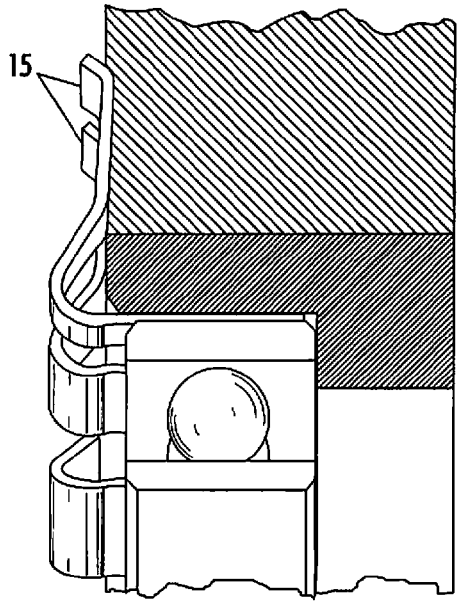

In FIGS. 6A and 6B a hookless washer embodiment of end washers 4 are illustrated.

In FIG. 5A, the use of a washer 4 with a fairly stiff outer perimeter 11 supported by a set of more flexible fingers 12 projecting towards the center. These fingers 12 are further shaped to provide a longer deformable length (large radius) as they are formed to project axially along the roll and engage the core 2 of the roller 1 parallel to its long axis. The finger embodiment shown is designed to engage a groove 13 on the inside of the bore that the bearing is pressed into. Alternatively, the groove 13 and corresponding hook can be eliminated and the washer retained by the press fit of the bearing along (shown in FIG. 6B). Or the hook feature 12 can project towards the center to engage a groove on the outside diameter of a core with or without a bearing press over it. In applications without a hook 12, some of the fingerlike projections are left flat to act as locator features when butted up against the end face of the core. And the tip of the fingers contacts the bottom of the bearing bore to limit pre-defection of the finger spring shape caused by them sticking to the bearing rather than the core during the bearing press operation.

This set of relatively compliant fingers 12 allows the washer 4 to apply a predictable and equal spring force on the rubber end face 3 over reasonable tolerance limits of the core to rubber trim. The washer load is also less influenced by thermal expansion of the rubber than in the prior art with a washer of the same thickness screwed to the core end. The stiffer outer portion 11 of the washer is able to exert high enough local load in the portion of the roll forming the nip 5 thereby reducing the tendency of the nip to get narrower as it gets closer to the roll end. It uses −0.5 mm less space than the screw head of a M2.5 screw. It uses about 5 mm less space than the wavy washer prior art. It is several dollars less expensive than the rigid washer set-up and over about $10 less than the screwed on set-up due to the cost of drilling and tapping a dozen small holes.

The hooked finger designs of FIGS. 5A and 5B could suffer from the slight problem of not being easily removable for re-manufacturing. The hook-less design of FIGS. 6A and 6B retained by the press fit load of the bearing is as easily removable as the bearing. Hook-less fingers, including V-shaped fingers 15 provide an easier to remove embodiment. By "V-shape" is meant throughout this disclosure and claims fingers 15 without a hook.

The hooked configuration has the advantage of greater flexibility of the finger 12 set if the clearance between the hooks and the bearing and bore is left large enough for the finger 12 to rotate slightly around the hook tip. When the finger 12 is tightly constrained between the core and bearing, the deformable zone of the finger is considerably stiffer compared to the case where rotation around the hook is allowed.

The above embodiments were made and tested. A tolerance ring was used between the bearing and the washer fingers 12 in the outer third of the bearing bore. This allowed the sheet metal thickness tolerance to be typical. The hook-less design of FIGS. 6A and 6B retained by press fit is being used and the sheet metal thickness controlled to tight tolerance via a coining operation.

An unexpected advantage of the design in FIGS. 6A and 6B is that the dust resulting from abrasions of the rubber by the washer 4 seems to migrate toward the center instead of outward. A simple ring of adhesive film applied over the fingers 12 covering the holes or spaces 14 between them is an effective trap of this dust.

In summary, this invention provides a flexible pressure roll for use in a fusing station of an electrostatic marking apparatus which comprises in an operative relationship a cylindrical metal core component, a main portion elastomeric coating encircling at least a major portion of said core component, and endplates positioned as washers at each end portion of said main portion elastomeric roll. This pressure roll is enabled to rotate against and in contact with a harder fuser roll in said fusing station. The pressure roll is also enabled when in said contact to cause a substantially uniform nip to be formed by a deformation of said pressure roll. The washers used comprise a substantially rigid ring portion having flexible fingers projecting from an inner portion of said ring portion towards a center of said ring, said ring portion being substantially more rigid than said flexible fingers and enabled to be attached around said core component. In one embodiment this pressure roll has washers that comprise hook sections on said flexible fingers. In another embodiment this pressure roll has washers that comprise V-shaped hook-less sections on said flexible fingers. All of the embodiments of the washers in the pressure roll comprise flexible fingers having spaces there between, and are adapted to fit around both terminal ends of said core component.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A flexible pressure roll for use in a fusing station of an electrostatic marking apparatus which comprises in an operative relationship a cylindrical core component, a main portion elastomeric coating encircling at least a major portion of said core component, and endplates positioned as washers at each end portion of said main portion elastomeric roll, said pressure roll enabled to rotate against and in contact with a harder fuser roll in said fusing station, said pressure roll enabled when in said contact to cause a substantially uniform nip to be formed by the deformation of said pressure roll, said washers comprising a substantially rigid ring portion having flexible fingers projecting from an inner portion of said ring portion towards a center of said ring, said ring portion being substantially more rigid than said flexible fingers and enabled to be attached around said core component, and wherein said washers comprise V-shaped sections on said flexible fingers.

2. The pressure roll of claim 1 wherein said washers comprise flexible fingers having spaces there between.

3. The pressure roll of claim 1 wherein said washers are adapted to fit around both terminal ends of said core component.

4. The pressure roll of claim 1 wherein said rigid circular ring portion is enabled to exert sufficient pressure on said elastomeric coating to minimize the tendency of a nip formed to get narrower as it gets closer to a roll end.

* * * * *